US005359164A

United States Patent [19]

Kucharski, Jr.

[11] Patent Number: 5,359,164

[45] Date of Patent: Oct. 25, 1994

[54] ILLUMINATED SWITCHING ASSEMBLY

[75] Inventor: John Kucharski, Jr., Itasca, Ill.

[73] Assignee: Eaton Corporation, Cleveland, Ohio

[21] Appl. No.: 63,582

[22] Filed: May 14, 1993

[51] Int. Cl.[5] ..... H01H 9/00

[52] U.S. Cl. ..... 200/315; 200/243; 200/302.1; 200/339; 200/284

[58] Field of Search ..... 200/315, 313, 314, 283, 200/284, 408, 453, 459, 460, 461, 243, 246, 339, 517, 302.1

[56] References Cited

U.S. PATENT DOCUMENTS

| | | | |
|---|---|---|---|
| 2,043,746 | 6/1936 | Garstang | 200/302.1 X |
| 2,795,678 | 6/1957 | Mertler | 200/302.1 |
| 2,889,423 | 6/1959 | Yochum | 200/302.1 X |
| 2,915,614 | 12/1959 | Loomis | 200/302.1 X |
| 3,291,926 | 12/1968 | Nelson | 200/302.1 X |
| 3,651,296 | 3/1972 | Yarbrough | 200/315 |
| 3,911,241 | 10/1975 | Jarrard | 200/517 |
| 3,973,091 | 8/1976 | Kaminski | 200/5 A |
| 3,996,431 | 12/1976 | Brown | 200/284 X |
| 4,209,677 | 6/1980 | Brown | 200/284 X |
| 4,309,816 | 1/1982 | Takeyama et al. | 200/302.1 X |
| 4,778,964 | 10/1988 | Kamisada | 200/284 |
| 4,967,046 | 10/1990 | Priesemuth | 200/339 |
| 5,013,266 | 5/1991 | Murphy et al. | 200/284 X |
| 5,089,715 | 2/1992 | Kokubu | 200/459 X |
| 5,099,091 | 3/1992 | Kokubu | 200/315 |
| 5,149,924 | 9/1992 | Priesemuth | 200/315 X |

FOREIGN PATENT DOCUMENTS

| | | | |
|---|---|---|---|
| 0338521 | 10/1989 | European Pat. Off. | 200/315 |
| 2807672 | 8/1979 | Fed. Rep. of Germany | 200/315 |
| 2904859 | 9/1980 | Fed. Rep. of Germany | 200/315 |
| 3137975 | 3/1983 | Fed. Rep. of Germany | 200/315 |
| 2223806 | 11/1974 | France | 200/315 |

*Primary Examiner*—Ernest G. Cusick
*Attorney, Agent, or Firm*—Roger A. Johnston

[57] ABSTRACT

A switching assembly of individually backlighted rocker actuated switches mounted in a common housing. The switch is built up by mounting connector terminals on a base, securing with an insulated anchor plate and stacking thereon an upper and lower bus, each formed of a conductive strip with plastic molded thereover. Each bus has cut-outs with portions of the conductor exposed therein and with mounting stanchions which bayonet through slots in the lower bus, and each stanchion has a switch blade staked onto it. The stationary contacts on the upper and lower bus are arranged in spaced stacked pairs with a blade mounted contact extending between each pair of stationary contacts. The upper and lower buses each have a terminal formed integrally and extending internally for bayonet contact with terminals on the base. The individual rocker actuators are mounted on the cover, which is snap-locked over the assembly of the base, busses and switches.

6 Claims, 9 Drawing Sheets

ILLUMINATED SWITCHING ASSEMBLY

BACKGROUND OF THE INVENTION

The present invention relates to electrical switching assemblies of the type having a plurality of user-operated actuators for selectively actuating individual switches mounted within a common housing. The invention relates particularly to switching assemblies of this type which have the actuators illuminated to facilitate user location and discernment of the state of actuation during nighttime operation.

Switching assemblies of this type are commonly employed in automotive applications for providing operator remote control of certain vehicle accessories, such as power lift windows, power operated door lock solenoids, power seat adjustments, control of electric window de-icers, and remote control of motorized adjustment of rear view mirrors. In such applications where substantial current, such as a window lift motor load, is switched, it has been found necessary to employ snap-action to ensure long contact service life. Snap-action switches also provide the desired tactile and audible feedback to the user that switch actuation has occurred. In these type of vehicle accessory control applications, it is desired to locate a group of switch actuators in a common location for controlling bi-directional operation of a plurality of control function motors. Where a plurality of snap-action switches are mounted on a common bus structure, however, undesirable or excessive audible noises from the bus have been encountered so as to render the switching objectionable by the user.

In automotive convenience switching applications, it is desirable to have the switches illuminated for nighttime ready identification of a particular switch function and for indication of the state of each actuation of the switch; and, it has been desired to have quiet operation of the snap switches where employed Where a plurality of snap acting switches are mounted on a common bus and encased in a common housing, it has been found that the mass and volume of the common housing bring about amplification of the audible noise of the snap-action of the switches.

In designing illuminated switching assemblies incorporating a plurality of individually actuated switches, particularly for automotive applications, it has been desired to minimize the volume or bulk of the switching assembly for facilitating mounting in readily accessible locations on the vehicle as, for example, on the vehicle door mounted arm rest. It has also been desired to render the switches as quiet as possible without significantly increasing the manufacturing cost and to provide for a low-cost, compact, reliable, readily assembled and easily installed switching assembly for connection to the vehicle body wiring harness. In particular, it has been desired to provide a simple, low cost and effective way of interconnecting a plurality of individual switches in a common closure or housing having individual actuators thereon, and to minimize the number of individual electrical connections required internally for the switching assembly, yet provide for wiring harness connection thereto with the required number of circuits for the desired control functions. It has also been desired to provide such a low-cost and quiet switching assembly having individual switch actuators backlighted for ease of user recognition during nighttime operation.

SUMMARY OF THE INVENTION

The present switching assembly provides for a plurality of individual backlighted actuators for a plurality of switches enclosed in a common housing means, with the stationary contact members of each switch disposed in spaced super-posed arrangement in lower and upper switch buses. The buses are each formed of a strip of conductive material encapsulated by molding insulating material thereover with portions of the strip exposed to provide for the location and attachment of the stationary switching contacts. The molded material serves to provide increased stiffness and dampening of the buses to improve the attenuation of the snap acting switches. The upper and lower buses are attached to the base portion of the housing means by suitable mechanical attachment, and locate the stationary contacts in spaced superposed pairs. The movable switching contact members for switching between the superposed stationary contacts are mounted on stanchions formed integrally with connector terminals; and, an anchor plate retains the connector terminals mounted on the base portion of the housing means. The stanchions extend upwardly through the lower bus to facilitate mounting of switch blades thereon.

The upper bus has integrally formed therewith towers of the molded insulating material for supporting lamps which illuminate transparent lens portions of the pivoted rocker type actuators mounted on the cover portion of the housing means to provide the backlighting of the actuators. In the preferred embodiment, the upper and lower busses, switches, anchor plate, and connector terminals are built up on the base of the housing means; and, the rocker type actuators are assembled onto the cover, which is then assembled over the base. The present invention thus provides a unique low-cost and easily assembled construction for a plurality of individual switches mounted in a common housing for quieted operation and having lamps therein for backlighting transparent portions of the actuators to facilitate operation of the switches during nighttime service.

DETAILED DESCRIPTION

Figure 2:
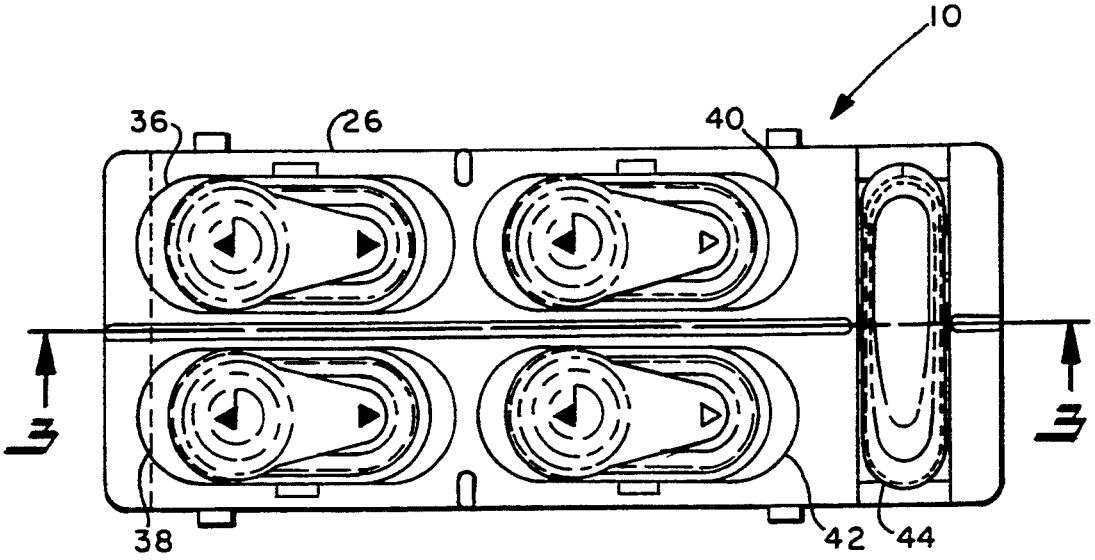
FIG. 2 is a top or plan view of the assembly of FIG. 1.
Figure 1:
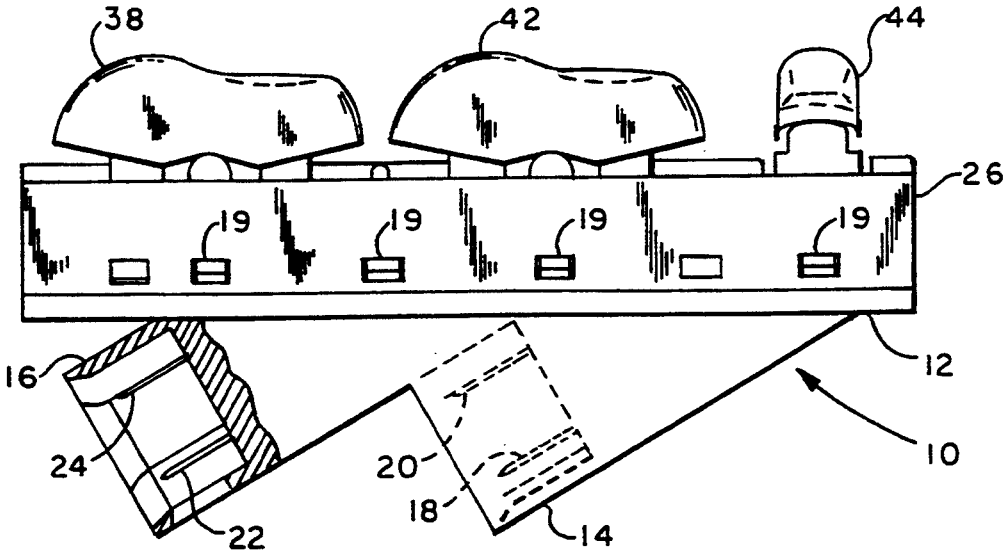
FIG. 1 is a front elevation of the switching assembly of the present invention.
Figure 3:
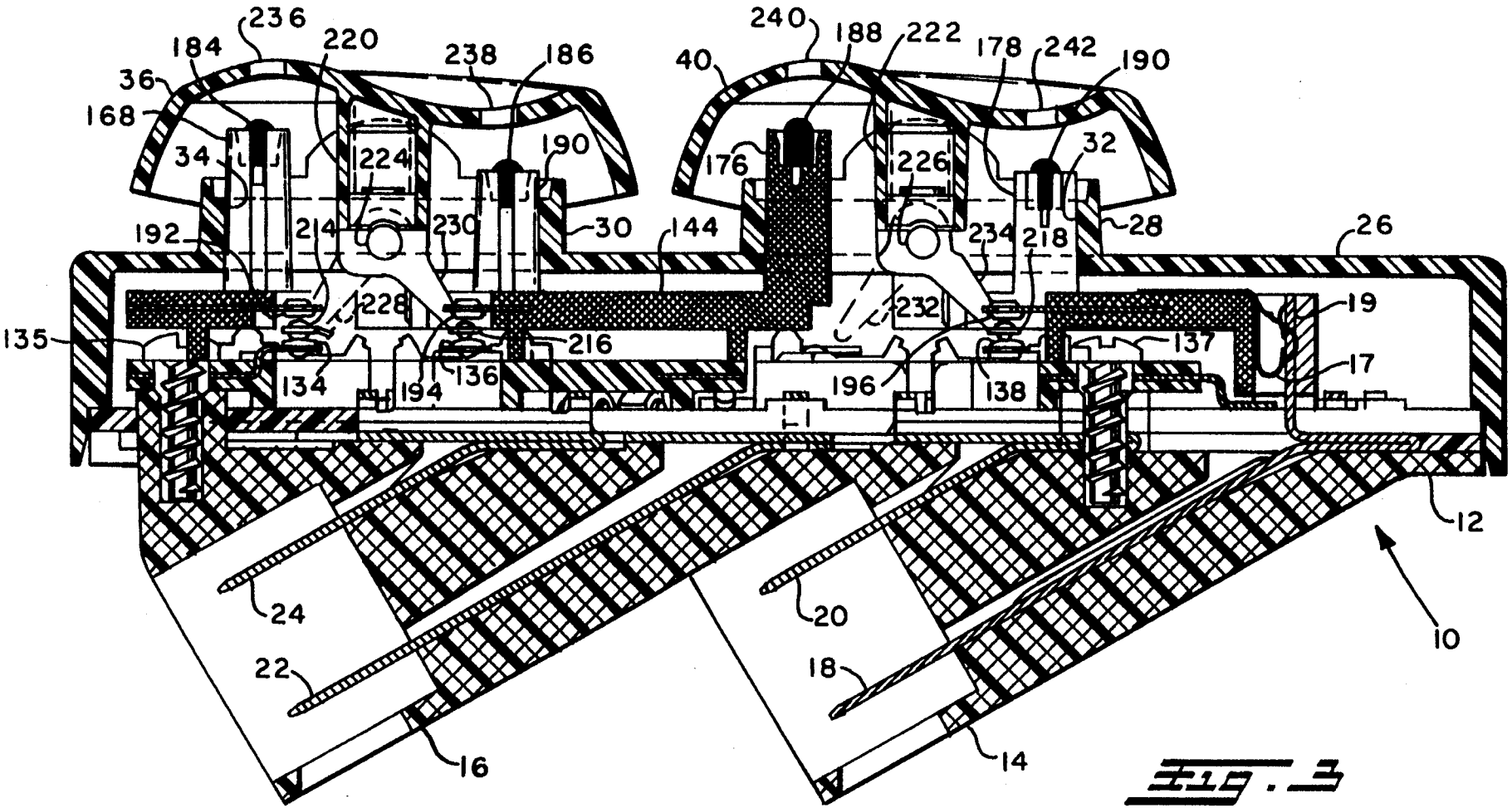
FIG. 3 is a section view taken along section-indicating lines 3—3 of FIG. 2.

Referring to FIGS. 1, 2, and 3, the switching assembly is indicated generally at 10 and has a housing means having a base 12 with a plurality of receptacles 14, 16 formed therein, each having two rows of electrical connecting terminals with one terminal from each row shown and denoted, respectively, by reference numerals 18,20,22,24, and which are adapted to be plugged into corresponding vehicle wiring harness connectors (not shown). The housing means also includes a cover shell 26 which is received over the base 12 and secured thereto by any suitable expedient as, for example, snap locking engagement over tabs 19. It will be understood that the housing means including the base 12 with integral receptacle portions 14, 16, and the cover 26 are formed of suitable insulating material as, for example, molded plastic.

The cover 26 has a plurality of raised peripherally continuous wall or flanged portions 28,30 which define apertures therethrough denoted by reference numerals 32,34 in FIG. 3 which provide for access to the interior of the housing for backlighting and switch actuation, as will hereinafter be described in greater detail.

A plurality of switch actuators in the form of rocker buttons is mounted pivotally on the cover 26 and are denoted by reference numerals 36,38,40,42,44 in FIGS. 1 and 2; it being understood that only two of the actuators 36,40 are illustrated in FIG. 3, and where actuator 44 has been omitted for simplicity of illustration.

Figure 4:
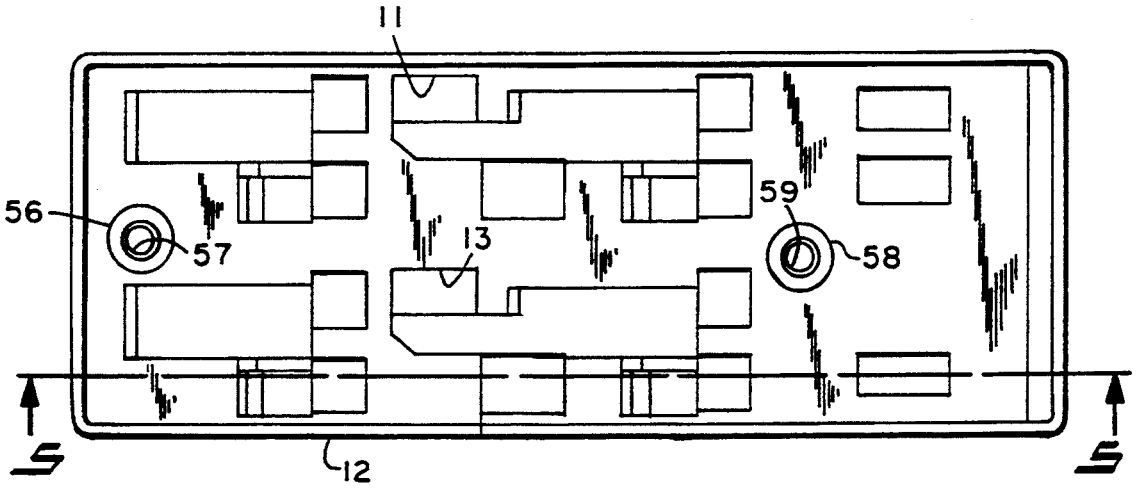
FIG. 4 is a plan view of the base of the housing means for the assembly of FIG. 1.
Figure 5:
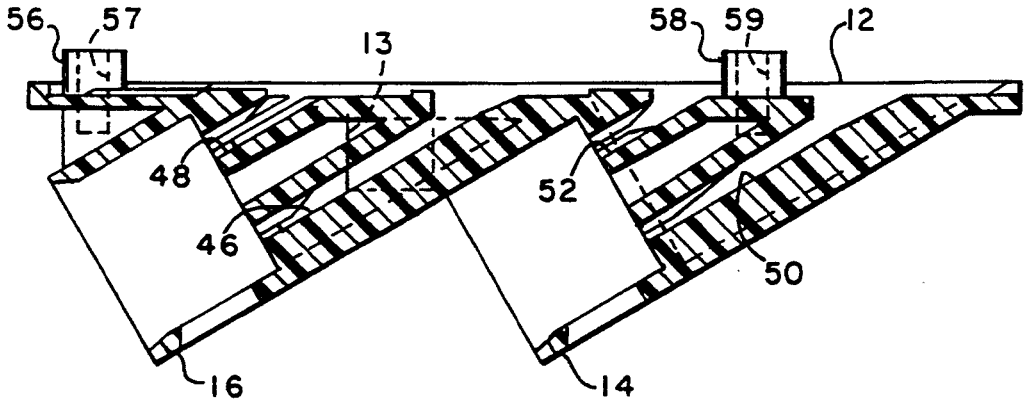
FIG. 5 is a section view, taken along section-indicating lines 5—5 of FIG. 4.
Figure 7:
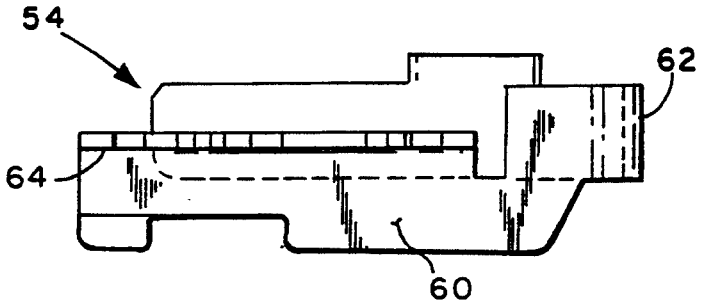
FIG. 7 is a top or plan view of the terminal of FIG. 6.
Figure 8:
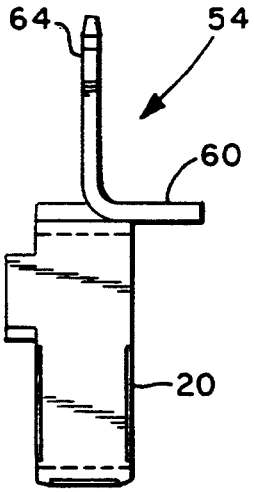
FIG. 8 is a side elevation view of the terminal of FIG. 6.
Figure 6:
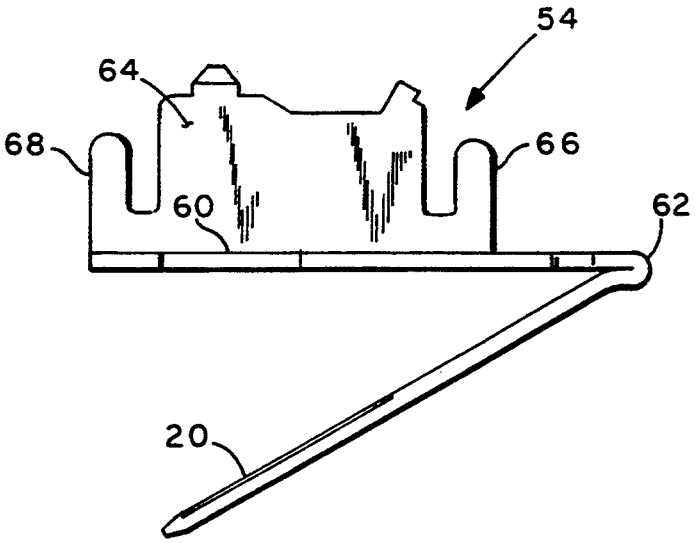
FIG. 6 is a front elevation view of a typical connector terminal with switch mounting stanchions thereon as employed in the assembly of FIG. 3.
Figure 9:
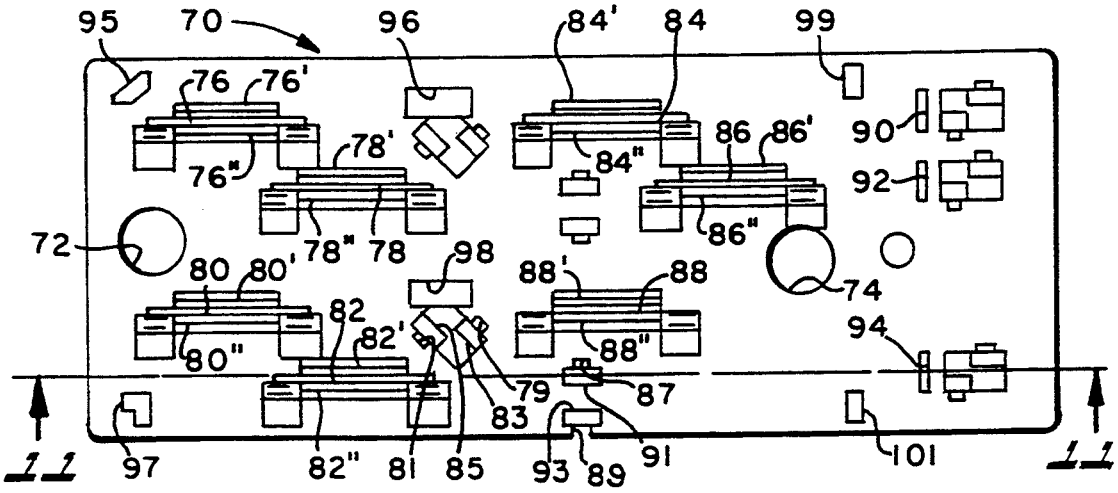
FIG. 9 is a plan or top view of the anchor plate of the assembly of FIG. 3.
Figure 10:
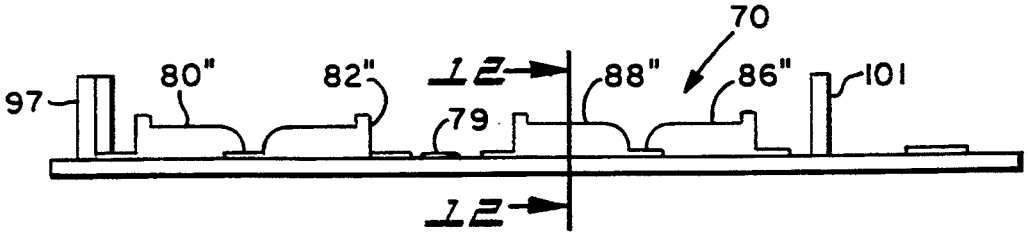
FIG. 10 is a front elevation view of the anchor plate in FIG. 9.
Figure 11:
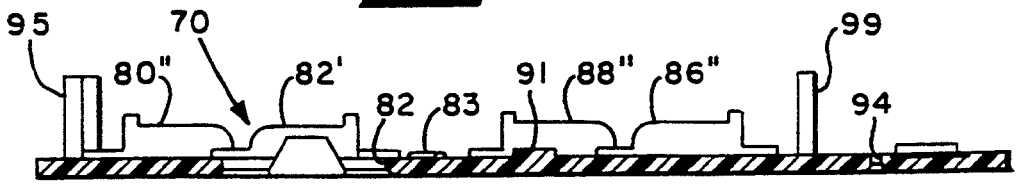
FIG. 11 is a section view taken along section-indicating lines 11—11 of FIG. 9.

Referring to FIGS. 3, 4, and 5, base 12, preferably formed of molded plastic insulating material, has a pair of parallel slots 46,48 mounted therein which extend into the receptacle 16 and are adapted to have the terminals 22,24 respectively received therein. A second set of parallel slots 50,52 is provided, which open into the interior of receptacle 14, and which are adapted to have terminals 18,20 respectively received therein. The upper surface of the base 12 has extending upwardly therefrom a pair of spaced towers 56,58, which have bores 57,59 respectively formed therein and which are adapted to have fastening means, such as self-sapping screws received therein. Base 12 also has a pair of spaced socket-receiving pockets or wells 11,13 formed therein.

Referring to FIGS. 3, 6, 7, and 8, the connector terminal 20 is illustrated as formed integrally depending from a connector member indicated generally at 54. Member 54 has a base flange portion 60 with the material on one end thereof folded back on itself at 62 and angled downwardly to form terminal 20. A vertically-extending mounting flange or stanchion is formed by folding upwardly a portion of the material of flange 60 along the side thereof, as denoted by reference numeral 64. The switch mounting flange or stanchion 64 has provided at opposite ends thereof integrally formed tabs 66,68 which extend in spaced-parallel relationship to the stanchion 64. It will be understood that the construction and configuration of member 54 is typical, and detailed description of the other connector terminal has been omitted for the sake of brevity.

Referring to FIG. 3, assembly of the switch assembly 10 is begun initially by assembling a connector member such as member 54 in one of the slots formed in base 12, such as slot 52; however, it will be understood that each of the slots 48,46,50,52 has a terminal member received therein, and appropriate ones each have a switch mounting stanchion, such as stanchion 64 extending upwardly from the base 12.

Figure 24:
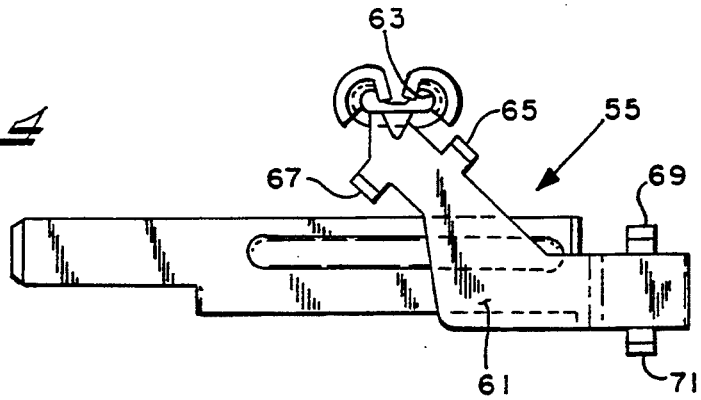
FIG. 24 is a plan view of the terminal of FIG. 23.
Figure 25:
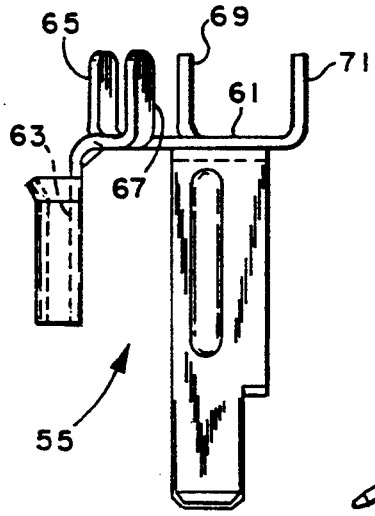
FIG. 25 is a side elevation view of the terminal of FIG. 23.
Figure 23:
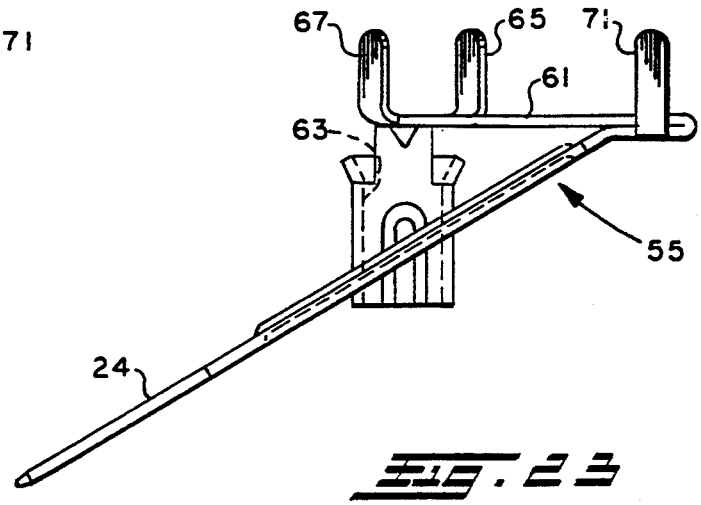
FIG. 23 is a front elevation view of another style of connector employed in the embodiment of FIG. 3.

Referring to FIGS. 23, 24, and 25, another form of connector terminal is illustrated generally at 55, and has a base flange or strip portion 61 which has one end thereof folded back on itself and bent downwardly at an angle to form the connector terminal 24 provided in base 12. A receptacle or socket portion 63 is formed integrally with and at right angles to the flange 61 and extends downwardly therefrom in the direction of the terminal 24. The base flange or strip 61 of terminal 55 also has a plurality of tabs denoted by reference numerals 65,67,69,71 formed integrally therewith and extending upwardly therefrom in spaced parallel relationship. Connector terminal 55 is received on base 12 with socket portion 63 extending downward into pocket or well 11 and 13.

Referring to FIGS. 9, 10, 11, and 12, an anchor plate indicated generally at 70 is formed of insulating material, preferably molded plastic, and has a pair of spaced apertures 72,74 formed therethrough which apertures are spaced and configured for having received therein respectively one of the screw towers 56,58 provided on the base 12. Anchor plate 70 has a plurality of spaced slots provided therethrough, as denoted by reference numerals 76 through 94. Slots 76 through 88 are disposed such that each coincides with the location of one of the switch mounting stanchions, such as stanchion 64 on connector terminal 54 when the anchor plate is located on the base 12. The anchor plate 70 is located on base 12 by means of screw towers 56,58 being received respectively in the apertures 72,74.

Each of the slots 76 through 86 inclusively is flanged along the longer edges thereof, by a pair of integrally molded locating and supporting flanges denoted respectively with a primed and double-primed corresponding reference numeral for each of the slots. For example, slot 86 is flanked by flanges 86′ and 86″.

Figure 12:
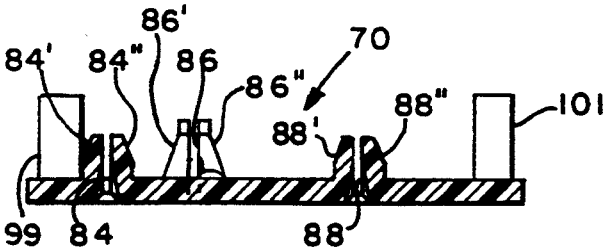
FIG. 12 is a section view taken along section-indicating lines 12—12 of FIG. 10.

Referring to FIG. 12, the supporting flanges are shown in greater detail for the slots denoted by reference numerals 84, 86, and 88. Adjacent the ends of each of the slots 76–88 inclusively are provided raised portions or ribs; and, one of these portions denoted by reference numeral 86''', is illustrated in FIG. 12, and is also shown in FIG. 13.

Figure 13:
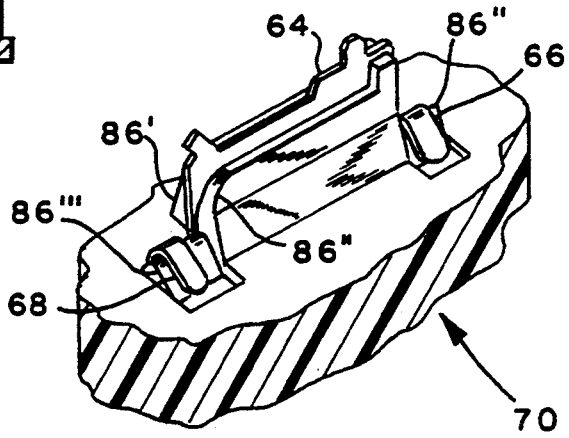
FIG. 13 is an axonometric view of a portion of the anchor plate of FIG. 9, with a switch stanchion extending therethrough.

Referring to FIG. 13, a portion of the anchor plate 70 is shown as received on the base 12 with the stanchion 64 on terminal member 54 received through slot 86 with the stanchion 64 extending upwardly between flanges 86',86''; and, tabs 68,66 are each folded over a rib 86''' to retain the terminal 54 securely in place. It will be understood that this arrangement is typical for each of the switch mounting stanchions.

The anchor plate slots 96,98 are disposed to coincide with pockets 11,13 respectively in the base 12, so that, upon assembly of the anchor plate 70 and the base 12, access to the connector terminal sockets, such as socket 63 in pocket 13, is facilitated.

The anchor plate 70 also has formed integrally therewith a plurality of spaced posts 95,97,99,101 which serve as support spaces for the upper bus.

Upon assembly of the anchor plate 70 onto the base, the lug 65 of connector terminal 55 is received through an aperture 81 formed in the anchor plate and tab 67 is received through an aperture 83 formed in the anchor plate. Tab 69 on connector terminal 55 extends upwardly through aperture 87 in the anchor plate, and tab 71 extends upwardly through aperture 89 provided in the anchor plate. It will be understood that a terminal member (not shown) substantially identical to member 55 is received on the base 12, and has a socket (not shown) similar to socket 63 and which is received in pocket 11 disposed immediately under and in position for access through aperture 96 provided in the anchor plate. Pocket 63 on member 55 is accessible through aperture 98 in anchor plate 70.

Upon assembly of the lower bus means 1 00 over the anchor plate the undersurface of the bus registers on posts 95,97,99, 101. It will be understood that the tab 133 on lower bus means 1 00 extends downwardly through aperture 96 in anchor plate 70, and into the connector socket (not shown) which is provided, similar to socket 63 of terminal 55, in pocket 11 of the base. Tabs 67,65 on terminal 55 extend upwardly through the anchor plate aperture 81,79, and are folded over ribs 85,83 respectively provided on the anchor plate in a manner similar to the folding of tabs 66,68 in FIG. 13, thus securing the connector terminal 55 securely to the anchor plate 70. In like manner, tab 69 extends upwardly through aperture 87 in the anchor plate and tab 71 extends upwardly through aperture 89 in the anchor plate; and, tabs 69 and 71 are respectively folded over ribs 91,93 provided on the anchor plate adjacent the apertures 87,89.

Figure 14:
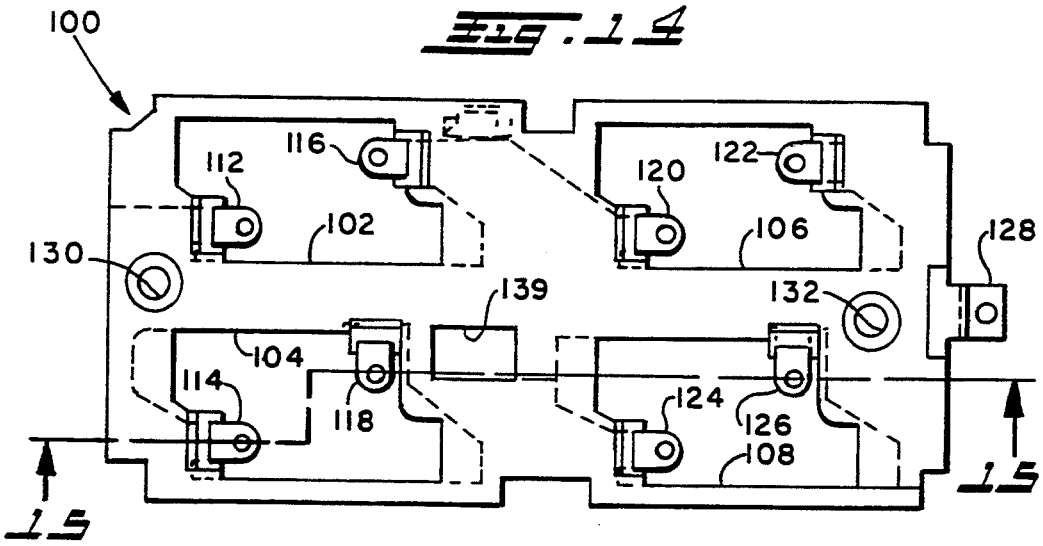
FIG. 14 is a plan view of the lower bus means employed in the assembly of FIG. 3.
Figure 15:
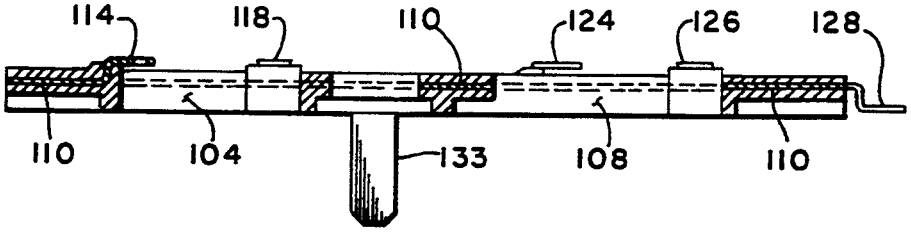
FIG. 15 is a section view taken along section-indicating lines 15—15 of FIG. 14.
Figure 17:
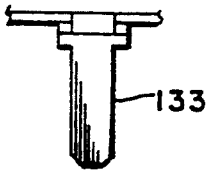
FIG. 17 is a section view taken along section-indicating lines 17—17 of FIG. 16.

Referring to FIGS. 14 through 17, the lower bus means is indicated generally at 100 and is formed of insulating plastic molded over a conductive insert. Lower bus 100 has a plurality of voids 102, 104, 106, 108 formed therein with portions of the insert comprising the flat conductor strip, indicated at 110 in FIG. 16, exposed to form mounting contact terminals denoted 112, 114, 116, 118, 120, 122, 124, 126, 128. It will be understood that the outline of the conductor strip 110 is shown in dashed outline in FIG. 14, with the portion shown in solid outline in FIG. 14 comprising plastic material molded over the conductor strip. Referring to FIG. 15, the contact mounting terminals 112 through 126 are offset upwardly so as to be aligned generally slightly above the upper surface of the molded plastic material on the bus means 100. The lower bus means 100 also has apertures 130, 132 provided therein for receiving fastening means such as screws therethrough. Apertures 130, 132 are located to coincide with screw towers 56,58. A tab 133 is formed integrally with strip 110 and is formed at right angles on the edge of strip 110 as shown in FIG. 17. An aperture 139 is formed in lower bus means 1 00 and is located to coincide with aperture 98 in anchor plate 70 to permit access to socket 63.

The lower bus means 100 is secured over the anchor plate 70 and onto the base means by suitable fastening means as, for example, self-tapping screws 135, 137 (see FIG. 3), which are received respectively through holes 130, 132 provided in the lower bus means, and holes 72,74 in the anchor plate to threadedly engage correspondingly located tap holes provided in the base 12 illustrated in FIGS. 4 and 5 and which are denoted by reference numerals 57,59.

Figure 16:
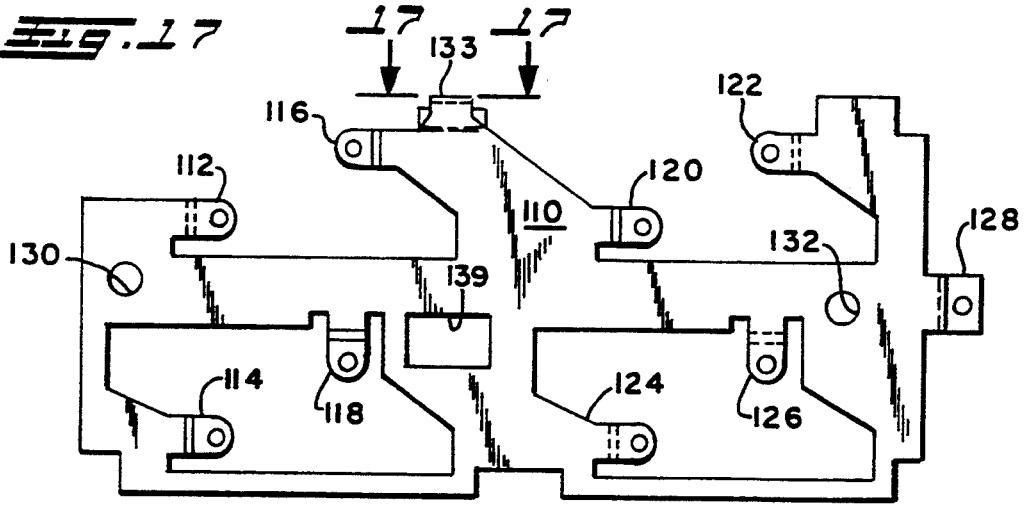
FIG. 16 is a plan view of the conductive strip employed in the lower bus means of FIG. 14.

Referring to FIGS. 14 through 16, it will be understood that each of the contact mounting terminals 112 through 126 has an electrical contact attached thereto, such as by riveting through the aperture shown in the respective mounting terminals. The contacts are omitted in FIGS. 14 through 16, but are shown in FIG. 3, and denoted by reference numerals 134, 136, 138.

Referring to FIGS. 18 through 22 inclusively, the upper bus means is indicated generally at 140 and comprises an elongated thin conductor strip 142 embedded in molded plastic material indicated in solid outline by reference numeral 144.

The upper bus means 140 has a plurality of cut-outs or voids formed therethrough as indicated by reference numerals 146, 148,150,152, each of which has lug portions of the conductor strip 142 exposed and extending therein on opposite sides of the cut-out to provide for attachment of suitable electrically conductive contacts (not shown) thereto, preferably by riveting. Cut-out 146 has exposed tabs 153,154 therein. Cut-out 148 has tabs 160,162 extending therein, cut-out 150 has tabs 156, 158 extending therein, and cut-out 152 has tabs denoted by reference numerals 164, 166 extending therein. Only tabs 160, 162, and 166 are visible in FIG. 20.

The upper bus means 140 has a connector terminal or tab 186 formed integrally therewith and extending downwardly therefrom at right angles thereto, and which is formed on the side of the conductor strip 142 between tabs 162, 164. Tab 186 is positioned so as to be located directly above aperture 139 formed in the lower bus means. Upon assembly of the upper bus means 140 onto the lower bus means 70, tab 168 is inserted downwardly through aperture 139, through aperture 98 in the anchor plate 70, and in bayonet fashion into the socket 63 of the connector terminal 55 located directly below aperture 98 in the anchor plate for providing electrical connection of the upper bus means to the connector terminals in the receptacle 16 formed on the base 12.

The upper bus means 140 also has a plurality of lamp towers molded integrally therewith and extending upwardly from the upper surface thereof, as denoted by reference numerals 168 through 182 inclusively. The towers are located on the upper bus means 140 so that a pair of towers extends upwardly through each opening in the cover 26 for each of the switch actuators 36 through 42.

Referring to FIG. 3, lamp towers 168 and 170 are shown as extending upwardly into the opening 34 provided in the cover for actuator 36. Towers 176 and 178 extend upwardly through the opening 32 provided in the cover for actuator 40. Each of the towers 168 through 182 has a lamp mounted in the upper end thereof, four of which are shown in FIG. 3 and denoted by reference numerals 184 through 190 inclusively.

The lamps may be LEDs which are inserted into slots provided in each tower, with the LED wire leads extending downward along the tower. The individual leads from the LEDs may then be soldered appropriate connector terminals such as spring 17 which engages vertical portion 19 of terminal 18.

Referring to FIG. 3, stationary electrical contacts are provided on the underside of exposed tabs of the upper bus means for each of the tabs 153 through 166, each of which is disposed directly above a corresponding contact tab of the lower bus means. It will be understood that each of the exposed contact tabs 153 through 166 has riveted thereto an electrical contact. Three of such contacts are shown in FIG. 3 for the tabs 160, 162, 166; and, the contacts are denoted by reference numerals 192, 194, 196.

Figure 18:
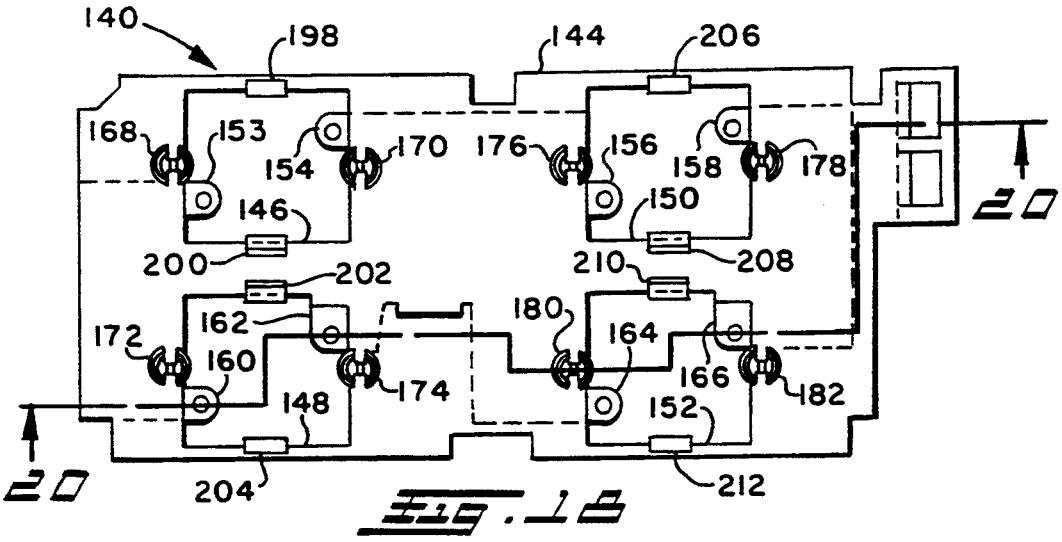
FIG. 18 is a plan view of the upper bus means of the assembly of FIG. 3.
Figure 19:
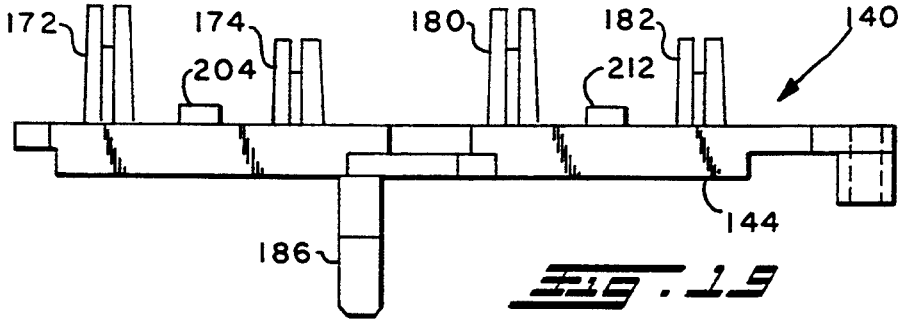
FIG. 19 is a front elevation view of the upper bus means of FIG. 18.
Figure 20:
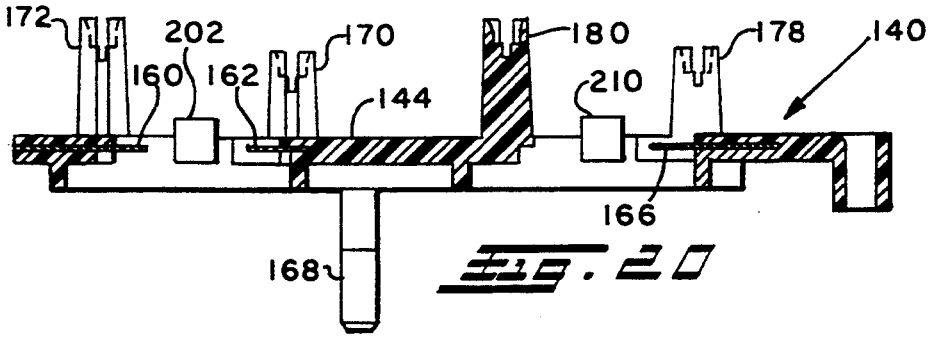
FIG. 20 is a section view taken along section-indicating lines 20—20 in FIG. 18.
Figure 21:
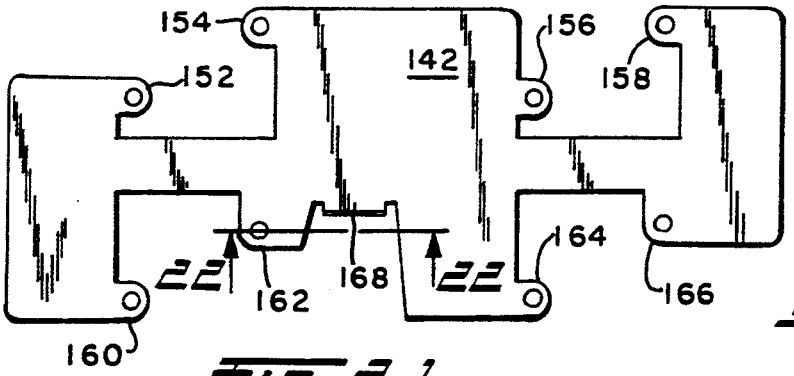
FIG. 21 is a plan view of the conductive strip of the bus means of FIG. 18; and, FIG. 22 is a section view taken along section-indicating lines 22—22 of FIG. 22.
Figure 22:
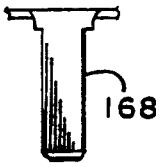

The upper bus means is also provided with a plurality of register or stops denoted by reference numerals 198 through 212 inclusively in FIGS. 18, 19, and 20, and which stops are shown extending upwardly from the upper surface of the bus means. Registers 198 through 21 2 are of a common height and serve as seats for the pins or axles such as axles 224,226, when the cover is installed over the upper bus means.

Referring to FIGS. 3, 13, and 23, movable switch blade mechanisms are attached to each of the switch mounting stanchions such as stanchion 64; and, the blade of each is disposed with its movable contacts between one of the vertically superposed spaced contact pairs. As shown in FIG. 3, movable switch contact 214 is disposed between lower and upper contact pairs 134,192; and a movable switch contact 21 6 is disposed between contact pairs 136, 194, and movable switch contact 218 is disposed between contact pairs 138,196, respectively on the lower and upper bus means.

Referring to FIG. 3, each of the switch actuators 36,38,40,42 has attached to the underside thereof a depending portion denoted respectively by reference numerals 220,222 for actuators 36,40. Each of the depending portions is individually pivotally mounted on the cover by pivot lugs provided thereon, or alternatively a pin therethrough. The pivot lugs for actuators 36,40 are shown in FIG. 3 and denoted by reference numerals 224,226. Each of the depending portions 220,222 has the lower end thereof bifurcated into two generally oppositely directed prongs which are denoted by reference numerals 228,230 for actuator depending portion 220 and reference numerals 232,234 for actuator depending portion 222. Each of the prongs 228,230 and 232,234 contacts one of the switch members mounted on the stanchions such as stanchion 64 shown in FIG. 13.

Figure 26:
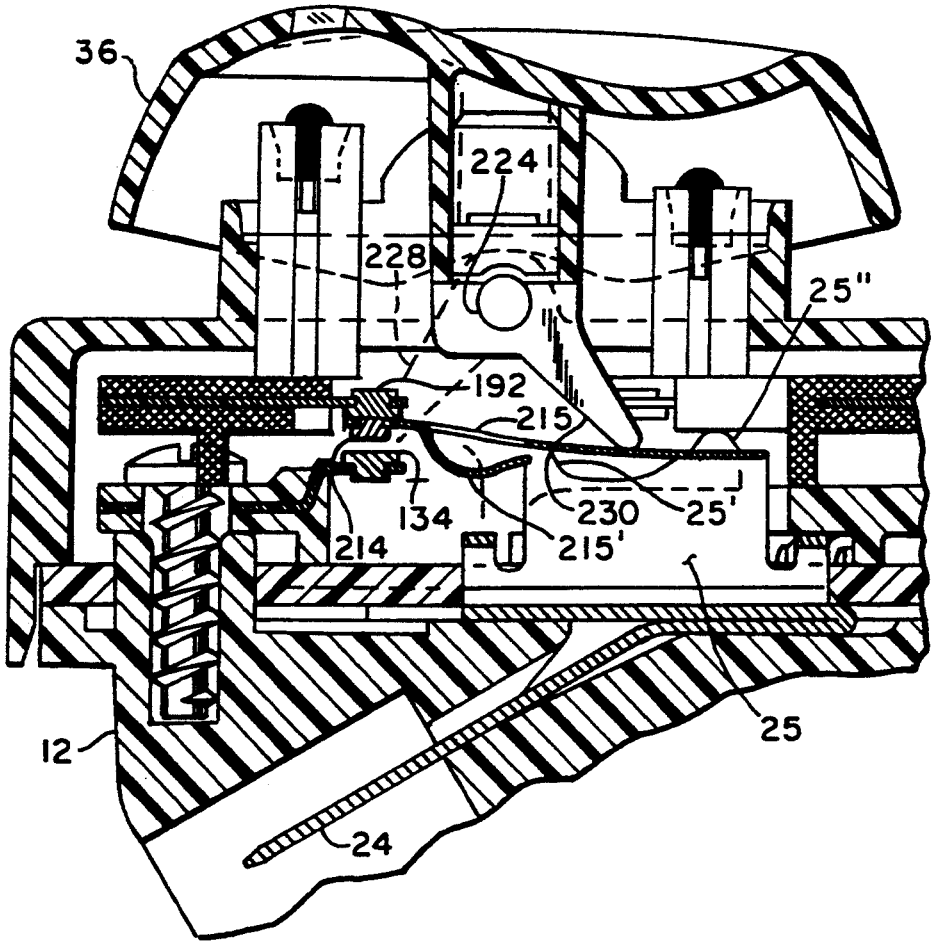
FIG. 26 is an enlarged view of a portion of FIG. 3.

Referring to FIG. 26, the movable contact 214 is shown typically as attached to a contact spring blade 21 5, which has a tab or tang 215' formed thereon which is engaged with a notch provided in tab 25' formed on the stanchion 25 which extends upwardly from the contact terminal 24. The base or remote end of blade 215 has an aperture therein which is received over and staked on a second tab 25" provided on stanchion 25 which is similar to stanchion 64 for terminal 20 shown in FIG. 6. It will be understood that the mounting of blade 215 for movable contact 214 is typical of the switch blade mounting for each of the stanchions such as stanchions 25 and 64, the latter being illustrated in FIG. 6 and FIG. 13 for connector terminal 20.

Upon clockwise pivotal movement of actuator 36, which causes the prong 230 to contact blade 21 5 and cause over-center movement thereof, the movable contact 214 is caused to transfer from its normally closed position against upper stationary contact 192, which is shown in FIG. 26 with a snap-action to a downward position contacting the lower stationary contact 134. Upon release of actuator 36 by the user, the spring forces in blade 21 5 cause the blade to move upward, again snapping over-center to return contact 21 4 to the upward position against contact 192; and, prong 230 returns the actuator 36 to its un-actuated position. It will be understood that the actuator 36 is shown in the un-actuated condition in FIGS. 3 and 26.

Referring to FIGS. 2 and 3, each of the actuators 36,38,40,42 has indicia thereon shown as black triangles which are illuminated by the corresponding adjacent lamp disposed underneath the actuator in the region of the indicia. The indicia are shown in FIG. 3 as comprising a translucent lens as denoted by reference numerals 236 through 242, it being understood that the lenses may be formed of transparent material if desired.

It will be understood that during assembly the actuator pivot lugs, such as lugs 224,236 are inserted into corresponding detent/recesses provided in the walls 30,28 surrounding the openings in the cover; and, the actuator lugs 224,236 are snap-locked therein prior to assembly of the cover onto the base and bus assembly. When the cover is received over the assemblage of the base, anchor plate, connector terminals, and upper and lower buses, the switch actuator prongs such as prongs 228,230,and 232,234 extend downwardly through the openings 34,32 provided in the cover and contact the switch blades. As the cover is snaplocked onto the base subassembly, the undersurface of the top of the cover registers against the towers on the upper bus means to retain the upper bus securely between the undersurface of the cover and the lower bus means.

The present invention thus provides a low-cost, readily manufactured switching assembly having a plurality of individually actuated switches mounted in a common housing, with connector terminals extending therefrom for external circuit connection thereto. The switches are preferably actuated by rocker type actuators which have individual lamp means provided thereunder for backlighting. The switch employs an upper and lower bus means, each of which is formed by molding plastic over a strip of conductive material, with cut-outs therein and portions of the strip exposed for attachment of individual stationary electrical contacts thereto. The upper and lower bus means are stacked in superposed relationship on a switch housing base. Switch blade stanchions are provided on connector terminals which bayonet through slots provided on the lower bus means; and, the switch blades are mounted on the lower bus means prior to stacking of the upper bus thereon. The upper bus has lamp towers provided thereon for mounting and positioning individual lamps for each of the actuators. The actuators are pivotally assembled to the cover, which upon snap-locking over the base, secures the upper bus in contact with the lower bus. Socket type electrical terminals are provided on the base with terminal tabs formed integrally with the exposed portion of the conductor on each bus. The terminal tabs on the buses make bayonet contact with the sockets provided on the terminal connectors on the base to electrically connect the buses to the connector terminals.

The insert molded buses thus enable stacked bayonet assembly and eliminate internal wiring in the assembly for low-cost manufacturing in high volume mass production.

Although the invention has hereinabove been described with respect to the illustrated embodiments, it will be understood that the invention is capable of modification and variation, and is intended as limited only by the spirit and scope of the followings claims.

I claim:

1. An illuminated electrical switching assembly comprising:

(a) base structure having plural electrical connector terminals thereon for external electrical connection thereto;

(b) a first bus means comprising an elongated strip of conductive material relatively thin with respect to its width, said strip encapsulated with insulating material molded thereover for stiffening and quieting said strip and having a plurality of first exposed portions with each of said first exposed portions having an electrical contact provided thereon;

(c) a second bus means comprising an elongated strip of conductive material relatively thin with respect to its width, said strip encapsulated with insulating material and having a plurality of second exposed portions with each of said second exposed portions having an electrical contact provided thereon; said second bus attached to said first bus with the electrical contacts on said second bus means disposed in spaced super-posed arrangement with the contacts on said first bus;

(d) a plurality of electrical switches, each with a movable contact member, each of said switches disposed for switching between a pair of said superposed contacts;

(e) actuator means operable upon user movement to effect switching of each of said switches; and, (f) lamp means attached to said second bus means and operable to illuminate said actuator means.

2. The assembly defined in claim 1, wherein said lamp means comprises plural light emitting diodes.

3. The assembly defined in claim 1, wherein said actuator means includes a rocker member operable to actuate a pair of said switches.

4. The assembly defined in claim 1, wherein said second bus includes a stanchion formed integrally with said insulating material for supporting said lamp means.

5. An illuminated switch assembly comprising:

(a) housing structure formed of insulating material and having plural connector terminal means mounted thereon;

(b) anchor plate means formed of electrically conductive material and having formed integrally therewith at least one connector terminal and at least one stanchion for switch blade mounting thereto, said plate means mounted on said housing means.

(c) first bus means comprising a strip of conductive material encapsulated with insulating material molded thereover for stiffening and quieting said strip and having first exposed portions for forming thereon at least one stationary electrical contact; said first bus means mounted on said housing structure in super-posed arrangement with said plate means and with said at least one connector terminal making electrical connection to said first bus means;

(d) second bus means comprising a strip of conductive material encapsulated with insulating material molded thereover for stiffening and quieting said strip and having second exposed portions for forming thereon at least one stationary electrical contacts, said second bus means mounted on said housing means with said at least one contact disposed in spaced super-posed relationship to said at least one contact of said first bus means;

(e) switch blade means mounted on said at least one stanchion and having contact means disposed between said at least one stationary contacts on said first and second bus means, said blade means operable to be moved for effecting switching current between said contacts;

(f) actuator means pivotably mounted on said housing means and operative upon user movement for effecting movement of said blade means; and, (g) means backlighting said actuator means.

6. The switch assembly defined in claim 5, wherein said actuator means includes transparent lens means and said means backlighting includes lamp means mounted on said second bus means.

* * * * *